US009659520B2

(12) United States Patent
Hsiao et al.

(10) Patent No.: US 9,659,520 B2
(45) Date of Patent: May 23, 2017

(54) GAMMA CORRECTION METHOD BASED ON A GAMMA CURVE OBTAINED FROM SINGLE OR MULTIPLE PRIMARY-COLOR FRAMES

(75) Inventors: Sheng-Jen Hsiao, Tainan (TW); Chia-Lin Wu, Tainan (TW)

(73) Assignee: Himax Display, Inc., Tainan (TW)

( * ) Notice: Subject to any disclaimer, the term of this patent is extended or adjusted under 35 U.S.C. 154(b) by 565 days.

(21) Appl. No.: 13/187,073

(22) Filed: Jul. 20, 2011

(65) Prior Publication Data

US 2012/0133681 A1 May 31, 2012

Related U.S. Application Data

(60) Provisional application No. 61/417,872, filed on Nov. 29, 2010.

(51) Int. Cl.
*G09G 3/36* (2006.01)
*G09G 3/20* (2006.01)

(52) U.S. Cl.
CPC ... *G09G 3/2007* (2013.01); *G09G 2300/0452* (2013.01); *G09G 2320/0673* (2013.01)

(58) Field of Classification Search
CPC ..... G09G 3/3696; G09G 230/0276; G09G 2320/06732
USPC ..... 345/88, 89, 690
See application file for complete search history.

(56) References Cited

U.S. PATENT DOCUMENTS

2006/0221020 A1* 10/2006 Winer et al. ..... 345/84
2006/0238551 A1* 10/2006 Dalal ..... 345/690
2007/0279433 A1* 12/2007 Huang ..... 345/601
2008/0024525 A1* 1/2008 Hsu ..... G09G 3/2044 345/690
2010/0128067 A1* 5/2010 Lee ..... H04N 1/407 345/690
2011/0122272 A1* 5/2011 Fergason ..... 348/222.1

FOREIGN PATENT DOCUMENTS

CN 1658679 8/2005
CN 101046567 10/2007
CN 100568337 C 12/2009
CN 101673520 3/2010
(Continued)

OTHER PUBLICATIONS

"Office Action of China Counterpart Application", issued on Dec. 4, 2013, p. 1-6.

(Continued)

*Primary Examiner* — Jonathan Blancha
(74) *Attorney, Agent, or Firm* — J.C. Patents

(57) ABSTRACT

A gamma correction method adapted for a liquid crystal display panel is provided. The gamma correction method includes the following steps. A reference gamma curve is provided. The LCD panel is lighted up with at least one of primary-color frames. Gamma voltages of the primary-color frame are set for the LCD panel based on the reference gamma curve to obtain at least one primary-color gamma curve. The gamma correction is performed on the LCD panel based on the at least one primary-color gamma curve or a linear combination curve of the at least one primary-color gamma curve. By using the gamma correction method, the LCD panel could be allowed to provide good image quality.

11 Claims, 6 Drawing Sheets

(56) References Cited

FOREIGN PATENT DOCUMENTS

| | | |
|---|---|---|
| TW | I224228 | 11/2004 |
| TW | 200510895 | 3/2005 |
| TW | 200540794 | 12/2005 |
| TW | 200615898 | 5/2006 |
| TW | 200744064 | 12/2007 |
| TW | 200849971 | 12/2008 |
| TW | 200929128 | 7/2009 |
| TW | 201004372 | 1/2010 |
| TW | 201040933 | 11/2010 |

OTHER PUBLICATIONS

"Office Action of Taiwan Counterpart Application", issued on Dec. 20, 2013, p. 1-16.
"Office Action of China Counterpart Application", issued on May 29, 2014, p. 1-7.

* cited by examiner

R G B R G B R G B

GAMMA CORRECTION METHOD BASED ON A GAMMA CURVE OBTAINED FROM SINGLE OR MULTIPLE PRIMARY-COLOR FRAMES

CROSS-REFERENCE TO RELATED APPLICATION

This application claims the priority benefits of U.S. provisional application Ser. No. 61/417,872, filed on Nov. 29, 2010. The entirety of the above-mentioned patent application is hereby incorporated by reference herein and made a part of this specification.

BACKGROUND OF THE INVENTION

Field of the Invention

The invention relates to a correction method, and more particularly to a gamma correction method.

Description of Related Art

In conventional displays, such as liquid crystal display (LCD), the adjustment of gamma curves and gamma reference voltages is executed by adjusting gray level voltages of displays to satisfy the standard gamma curve (e.g. gamma curve 2.2), while the displays are lighted up with white frames. In such a way, the displays would show the expected gray levels. However, for displaying pure color frames such as red frames, green frames, and blue frames, the displayed gray levels are much poorer than that of the white frame.

FIG. 1 illustrates gamma curves of the conventional displays. Referring to FIG. 1, the horizontal axis indicates gray levels, and the vertical axis indicates reflectance. The heavy line is the standard gamma curve 2.2, and the gamma voltages of the displays are adjusted based on the standard gamma curve 2.2 when the displays are lighted up with the white frames. On the other hand, the gamma curves of pure color frames could be obtained by optical measurement when the displays are lighted up the pure color frames. The three dashed curves shown in FIG. 1 are the gamma curves of pure color frames. It could be found that there are much offsets between the gamma curves of pure color frames and the standard gamma curve 2.2. As a result, the image quality is poor, and some issues such as poor color and contour effect are induced. In order to improve image quality, a suitable gamma correction method is necessary.

SUMMARY OF THE INVENTION

The invention is directed to a gamma correction method capable of allowing the display to provide good image quality.

The invention provides a gamma correction method adapted for an LCD panel. The gamma correction method includes the following steps. A reference gamma curve is provided. The LCD panel is lighted up with a first primary-color frame. Gamma voltages of the first primary-color frame for the LCD panel are set based on the reference gamma curve to obtain a first gamma curve.

In an embodiment of the invention, the gamma correction method further includes the following step. The gamma correction is performed on the LCD panel based on the obtained first gamma curve.

In an embodiment of the invention, the gamma correction method further includes the following steps. The LCD panel is lighted up with a second primary-color frame. The gamma voltages of the second primary-color frame are set for the LCD panel based on the reference gamma curve to obtain a second gamma curve.

In an embodiment of the invention, the gamma correction method further includes the following step. The gamma correction is performed on the LCD panel based on at least one of the first gamma curve and the second gamma curve.

In an embodiment of the invention, the gamma correction method further includes the following steps. The first gamma curve and the second gamma curve are linearly combined to obtain a first combination curve of the first gamma curve and the second gamma curve. The gamma correction is performed on the LCD panel based on the obtained first combination curve.

In an embodiment of the invention, the gamma correction method further includes the following steps. The LCD panel is lighted up with a third primary-color frame. The gamma voltages of the third primary-color frame are set for the LCD panel based on the reference gamma curve to obtain a third gamma curve.

In an embodiment of the invention, the gamma correction method further includes the following step. The gamma correction is performed on the LCD panel based on at least one of the first gamma curve, the second gamma curve, and the third gamma curve.

In an embodiment of the invention, the gamma correction method further includes the following steps. The first gamma curve, the second gamma curve, and the third gamma curve are linearly combined to obtain a second combination curve of the first gamma curve, the second gamma curve, and the third gamma curve. The gamma correction is performed on the LCD panel based on the obtained second combination curve.

The invention provides a gamma correction method adapted for an panel. The gamma correction method includes the following steps. A reference gamma curve is provided. The LCD panel is sequentially lighted up with a first primary-color frame, a second primary-color frame, and a third primary-color frame during a first period, a second period, and a third period respectively. Gamma voltages are respectively set for the LCD panel based on the reference gamma curve during the first period, the second period, and the third period to obtain a first gamma curve, a second gamma curve, and a third gamma curve.

In an embodiment of the invention, the gamma correction method further includes the following step. The gamma correction is performed on the LCD panel based on at least one of the first gamma curve, the second gamma curve, and the third gamma curve.

In an embodiment of the invention, the gamma correction method further includes the following steps. At least two of the first gamma curve, the second gamma curve, and the third gamma curve are linearly combined to obtain a combination curve. The gamma correction is performed on the LCD panel based on the combination curve.

In an embodiment of the invention, the first primary-color frame, the second primary-color frame, and the third primary-color frame comprise a red frame, a green frame, and a blue frame.

In an embodiment of the invention, the LCD panel is a liquid crystal on silicon panel with color filters.

According to the above descriptions, the gamma correction is performed on the LCD panel based on the first gamma curve, the second gamma curve, the third gamma curve, or the combination curve thereof in the invention. Accordingly, by using the gamma correction method, the LCD panel could be allowed to provide good image quality.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
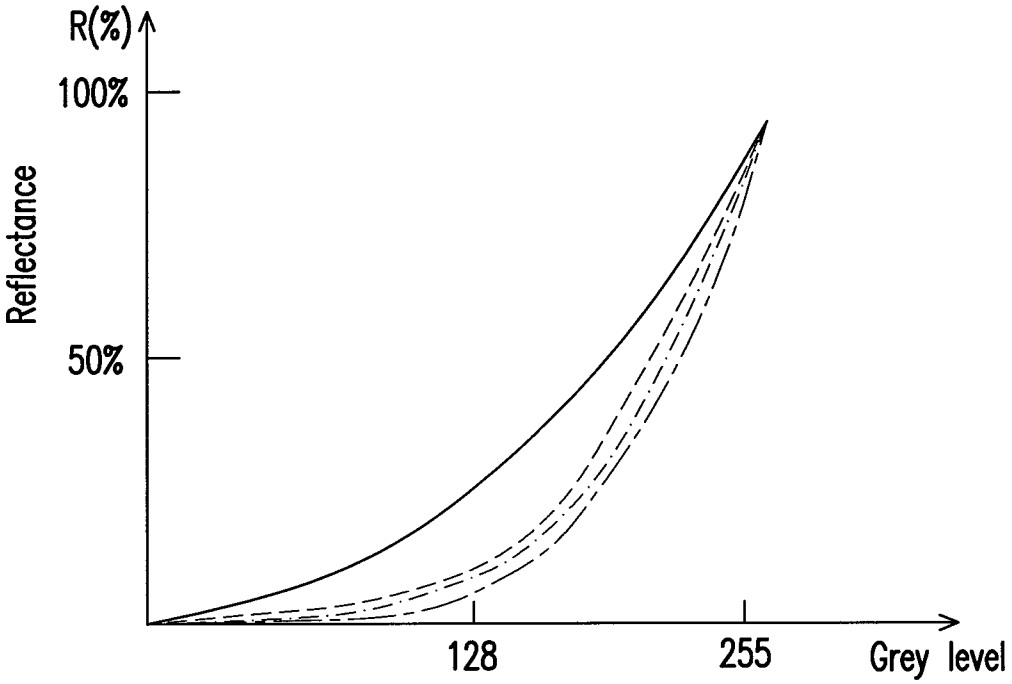
FIG. 1 (RELATED ART)
FIG. 1 illustrates gamma curves of the conventional displays.
Figure 2:
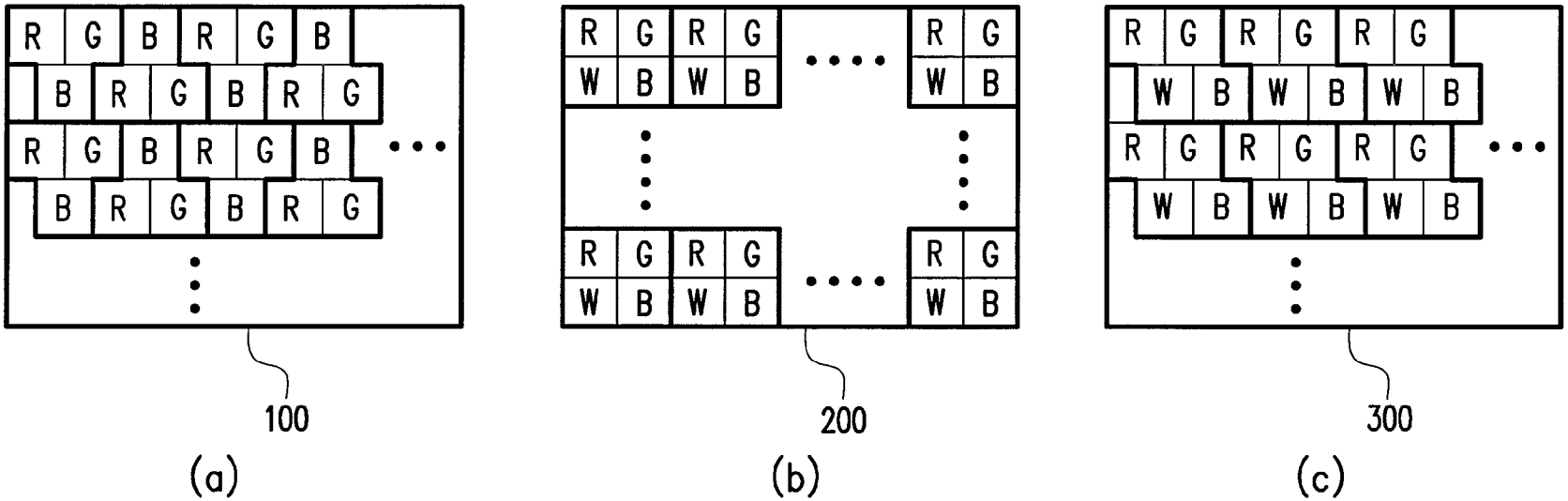
FIG. 2 illustrates three types of LCD panel structures according to an embodiment of the invention.

FIG. 2 illustrates three types of liquid crystal display (LCD) panel (e.g. LCoS-CF panel, liquid crystal on silicon panel with color filters) structures according to an embodiment of the invention. Based on the arrangement of pixels, the LCD panels could be categorized into at least three types, including an RGB mode, an RGBW mosaic mode, and an RGBW delta mode. FIG. 2(*a*) to FIG. 2(*c*) respectively shows the LCD panels with color filters arranged in the RGB mode, in the RGBW mosaic mode, and in the RGBW delta mode. The LCD panel 100 of the RGB mode simply includes red pixels, green pixels, and blue pixels. By contrast, the LCD panels 200 and 300 of the RGBW mosaic mode and the RGBW delta mode further include white pixels. Herein, the signs "R," "G," "B," and "W" marked in each block of the LCD panels 100, 200, and 300 represent the pixel colors.

In exemplary embodiments of the invention, the gamma correction method can be adopted in the three types of the LCD panels as shown in FIG. 2(*a*) to FIG. 2(*c*). In the following description, the LCD panel 100 of the RGB mode is exemplary, but the invention is not limited thereto.

Figure 3:
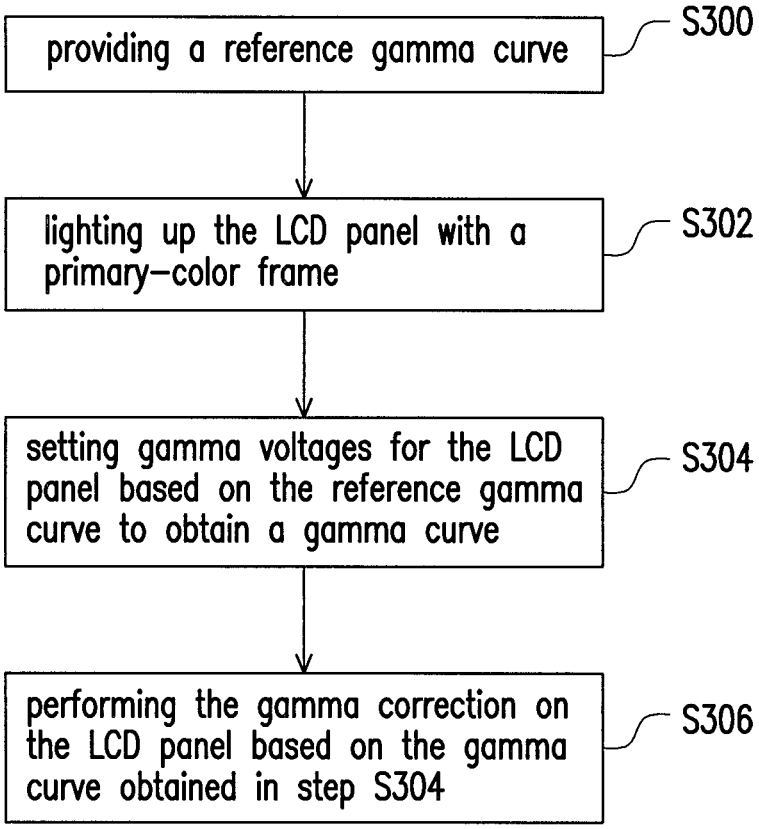
FIG. 3 illustrates a flowchart of the gamma correction method according to an embodiment of the invention.

FIG. 3 illustrates a flowchart of the gamma correction method according to an embodiment of the invention. Referring to FIG. 3, the gamma correction method may be adopted in the LCD panel 100 of the RGB mode in the present embodiment. The LCD panel 100 of the RGB mode includes red pixels, green pixels, and blue pixels arranged in the RGB mode as shown in FIG. 2(*a*).

In step S300, a reference gamma curve is provided. Herein, for example, the standard gamma curve 2.2 is chosen. Next, in step S302, the LCD panel 100 is lighted up with a primary-color frame. The primary-color frame may be a red frame, a green frame, or a blue frame. It should be noted that the primary-color frame does not include white frames in the present embodiment. Thereafter, in step S304, gamma voltages are set for the LCD panel 100 based on the reference gamma curve to obtain a gamma curve.

Figure 4:
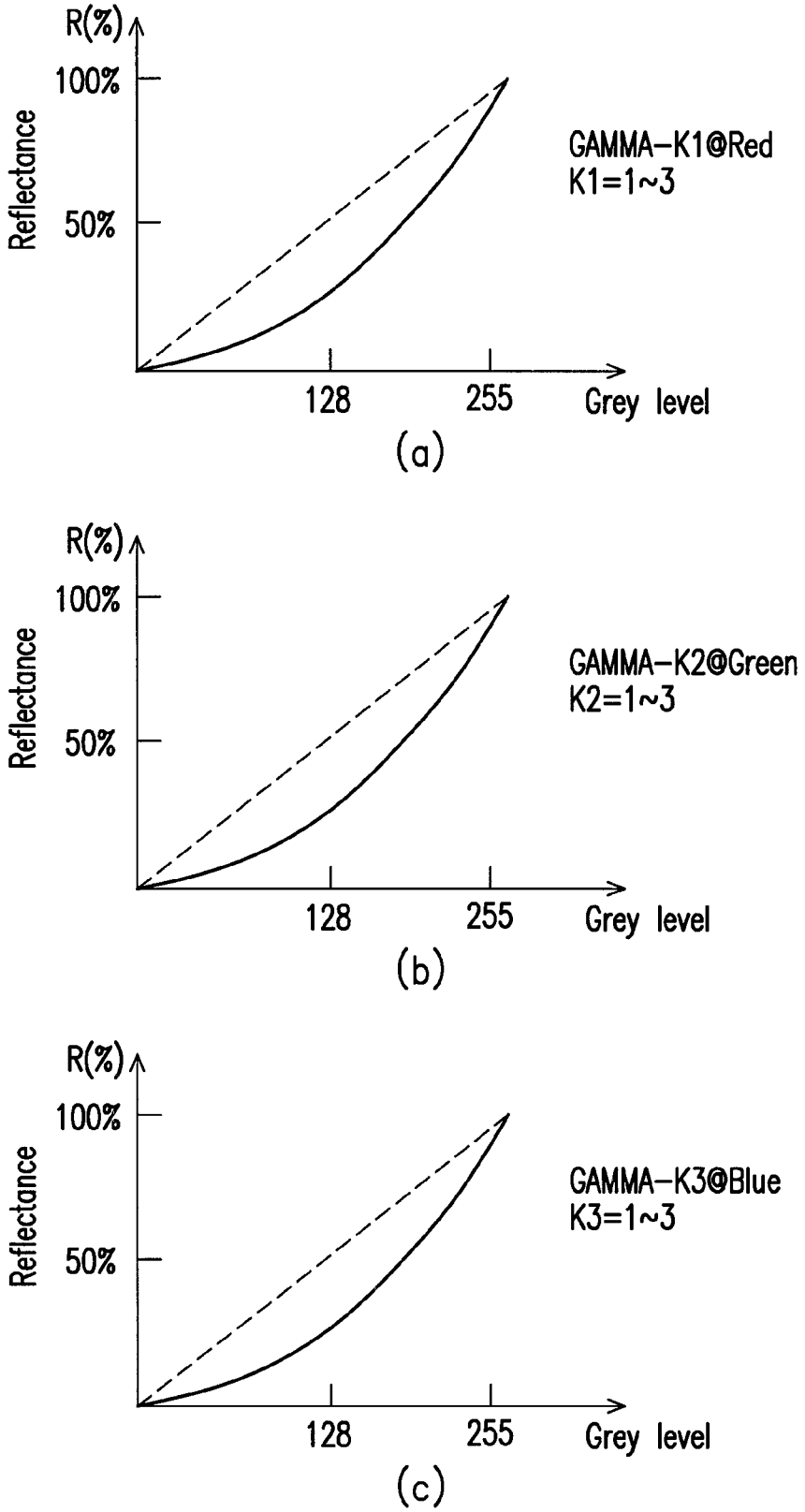
FIG. 4 illustrates gamma curves of different color frames according to an embodiment of the invention.

FIG. 4 illustrates gamma curves of different color frames according to an embodiment of the invention. FIG. 4(*a*) shows the gamma curve of red frame. In step S302, if the LCD panel 100 is lighted up with a red frame, a gamma curve such as the gamma curve of red frame shown in FIG. 4(*a*) would be obtained in step S304. In the present embodiment, the gamma curve of red frame is obtained according to one of the standard gamma curves with a gamma value K1, and the gamma value K1, for example, satisfies the following condition: $1<K1<3$. As illustrated in step S302, the standard gamma curve 2.2 is chosen for a reference gamma curve, so the gamma curve of red frame is obtained according to the standard gamma curve with the gamma value 2.2. However, the invention is not limited thereto. Next, in step S306, the gamma correction is performed on the LCD panel 100 based on the gamma curve obtained in step S304. Herein, the gamma curve obtained in step S304 may be the gamma curve of red frame shown in FIG. 4(*a*). In other words, in the present embodiment, when the gamma correction is performed, the gamma voltages of the LCD panel 100 are set based on the gamma curve of red frame.

On the other hand, FIG. 4(*b*) and FIG. 4(*c*) respectively show the gamma curves of green frame and blue frame. Herein, the gamma curves of green frame and blue frame are respectively according to the standard gamma curves with gamma values K2 and K3, and the gamma values K2 and K3, for example, respectively satisfies the following conditions: $1<K2<3$ and $1<K3<3$. Similarly, in other embodiments, if the LCD panel 100 is lighted up with a green frame or a blue frame in step S302, a gamma curve shown in FIG. 4(*b*) or FIG. 4(*c*) would be obtained in step S304. That is to say, in these embodiments, when the gamma correction is performed, the gamma voltages of the LCD panel 100 are set based on the gamma curve of green frame or blue frame.

Figure 5:
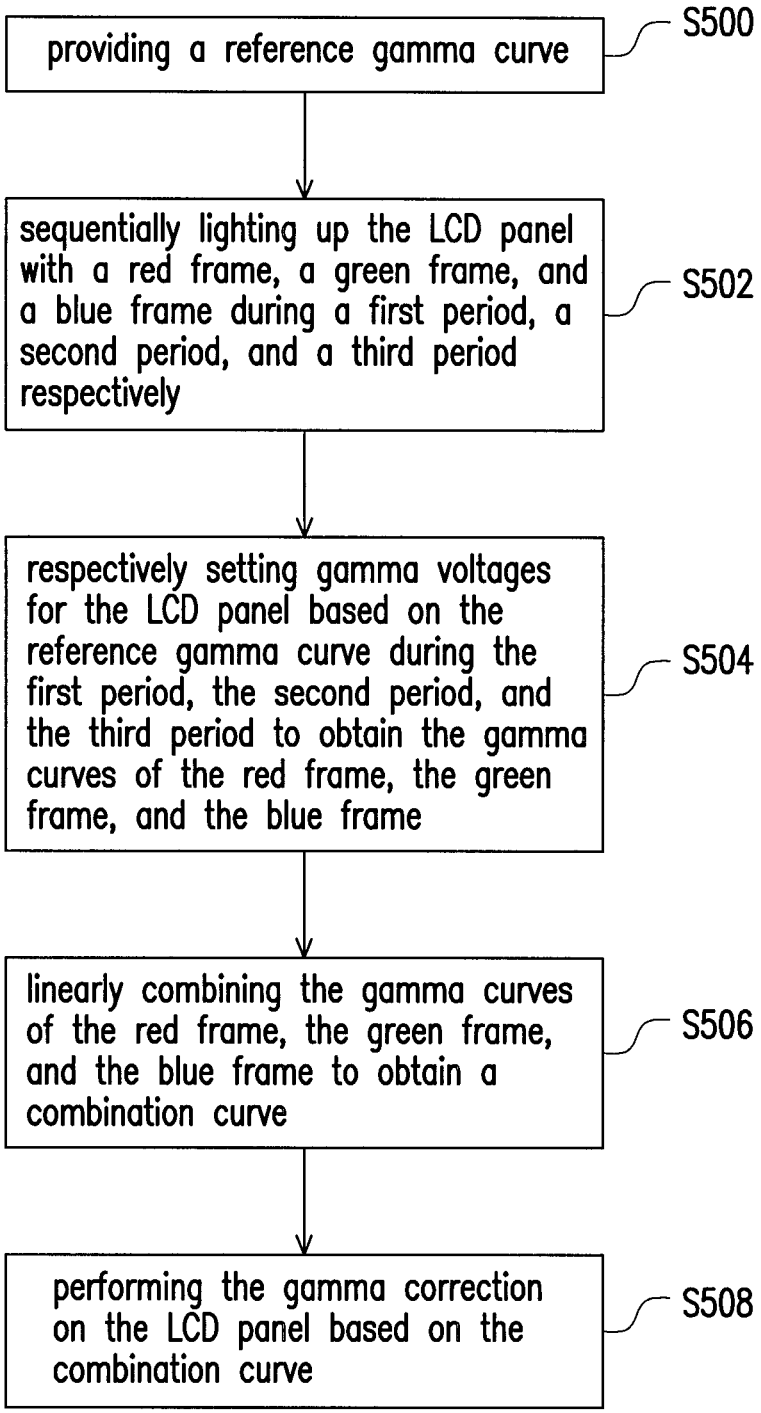
FIG. 5 illustrates a flowchart of the gamma correction method according to an embodiment of the invention.

FIG. 5 illustrates a flowchart of the gamma correction method according to an embodiment of the invention. Referring to FIG. 5, the gamma correction method may be adopted in the LCD panel 100 of the RGB mode in the present embodiment. In step S500, a reference gamma curve such as the standard gamma curve 2.2 is provided. Next, in step S502, the LCD panel 100 is sequentially lighted up with a red frame, a green frame, and a blue frame during a first period, a second period, and a third period respectively. It should be noted that the primary-color frames in the present embodiment include a red frame, a green frame, and a blue frame, but not include white frames. Thereafter, in step S504, gamma voltages are respectively set for the LCD panel 100 based on the reference gamma curve during the first period, the second period, and the third period to obtain the gamma curves of the red frame, the green frame, and the blue frame. The gamma curves of the red frame, the green frame, and the blue frame, for example, are respectively shown as the gamma curves of FIG. 4(*a*), FIG. 4(*b*), and FIG. 4(*c*).

Figure 6:
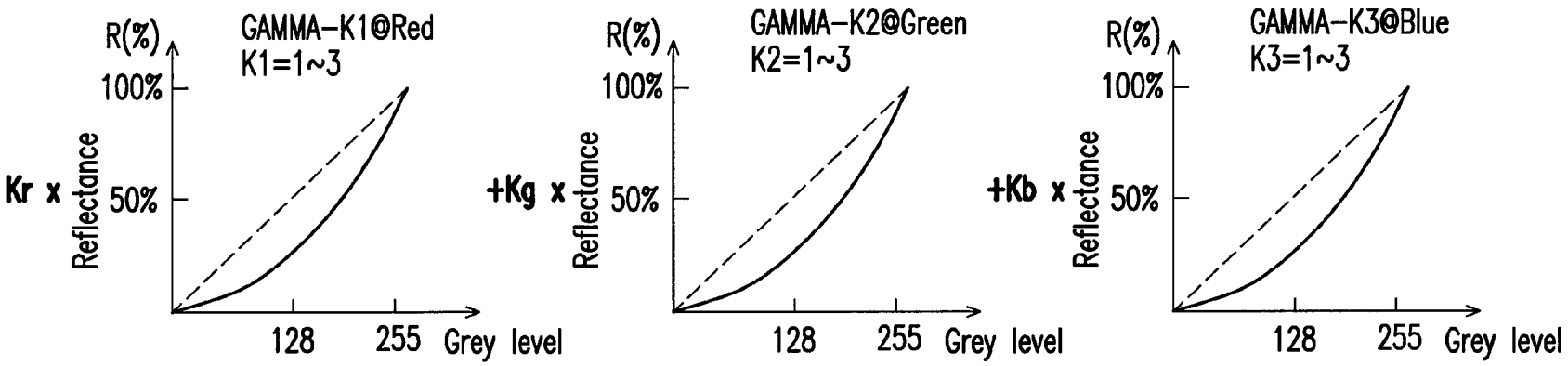
FIG. 6 illustrates a schematic diagram of the linear combination of the gamma curves of the primary-color frames according to an embodiment of the invention.

Next, in step S506, the gamma curves of the red frame, the green frame, and the blue frame are linearly combined to obtain a combination curve. FIG. 6 illustrates a schematic diagram of the linear combination of the gamma curves of the red frame, the green frame, and the blue frame according to an embodiment of the invention. Referring to FIG. 6, parameters Kr, Kg, and Kb represent the gamma curves of the primary-color frames which account for the combination curve, where Kr, Kg, or $Kb=n/m$, n and m are integers and $m\neq 0$. In the present embodiment, each of the parameters Kr, Kg, and Kb, for example, is one-third. In other words, the combination curve is an average of the gamma curves of the primary-color frames, and serves as the setting of gamma voltages for the LCD panel 100. In other embodiments, the combination curve may be simply linearly combined by any two of the gamma curves of the primary-color frames. Thereafter, in step S508, the gamma correction is performed on the LCD panel 100 based on the combination curve.

It should be noted that, the order of lighting up the LCD panel 100 with the red frame, the green frame, and the blue frame may be changed according to the design, and the invention is not limited thereto. Furthermore, in another embodiment, the gamma correction may be performed on the LCD panel based on one or two of the gamma curves of the primary-color frames.

In summary, the gamma curves of the primary-color frames or the combination curve thereof is obtained in the exemplary embodiments, and the gamma correction is performed on the LCD panel based on one of the gamma curves of the primary-color frames or the combination curve. Accordingly, by using the gamma correction method, the LCD panel could be allowed to provide good image quality.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A gamma correction method, adapted for an LCD panel, the gamma correction method comprising:

providing a reference gamma curve;

lighting up the LCD panel with a first primary-color frame;

setting gamma voltages of the first primary-color frame for the LCD panel based on the reference gamma curve to obtain a first gamma curve;

lighting up the LCD panel with a second primary-color frame;

setting the gamma voltages of the second primary-color frame for the LCD panel based on the reference gamma curve to obtain a second gamma curve;

linearly combining the first gamma curve and the second gamma curve to obtain a first combination curve of the first gamma curve and the second gamma curve, wherein the first combination curve does not change along with input source; and performing the gamma correction on the LCD panel based on the obtained first combination curve, wherein only the first combination curve is applied to set gamma voltages for red pixels, blue pixels and green pixels of the LCD panel, such that ranges of all the gamma voltages for the red pixels, the blue pixels and the green pixels varied within a same range of gray levels are the same, and the gamma voltages of the red pixels, the blue pixels and the green pixels having the same gray level set by the first combination curve are the same.

2. The gamma correction method as claimed in claim 1, further comprising:

performing the gamma correction on the LCD panel based on the obtained first gamma curve.

3. The gamma correction method as claimed in claim 1, further comprising:

performing the gamma correction on the LCD panel based on at least one of the first gamma curve and the second gamma curve.

4. The gamma correction method as claimed in claim 1, further comprising:

lighting up the LCD panel with a third primary-color frame; and setting the gamma voltages of the third primary-color frame for the LCD panel based on the reference gamma curve to obtain a third gamma curve.

5. The gamma correction method as claimed in claim 4, further comprising:

performing the gamma correction on the LCD panel based on at least one of the first gamma curve, the second gamma curve, and the third gamma curve.

6. The gamma correction method as claimed in claim 4, wherein the first primary-color frame, the second primary-color frame, and the third primary-color frame comprise a red frame, a green frame, and a blue frame.

7. The gamma correction method as claimed in claim 1, wherein the LCD panel is a liquid crystal on silicon panel with color filters.

8. A gamma correction method, adapted for an LCD panel, the gamma correction method comprising:

providing a reference gamma curve;

sequentially lighting up the LCD panel with a first primary-color frame, a second primary-color frame, and a third primary-color frame during a first period, a second period, and a third period respectively;

respectively setting gamma voltages for the LCD panel based on the reference gamma curve during the first period, the second period, and the third period to obtain a first gamma curve, a second gamma curve, and a third gamma curve;

linearly combining at least two of the first gamma curve, the second gamma curve, and the third gamma curve to obtain a combination curve, wherein the first combination curve does not change along with input source; and performing the gamma correction on the LCD panel based on the obtained combination curve, wherein only the combination curve is applied to set gamma voltages for red pixels, blue pixels and green pixels of the LCD panel, such that ranges of all the gamma voltages for the red pixels, the blue pixels and the green pixels varied within a same range of gray levels are the same, and the gamma voltages of the red pixels, the blue pixels and the green pixels having the same gray level set by the first combination curve are the same.

9. The gamma correction method as claimed in claim 8, further comprising:

performing the gamma correction on the LCD panel based on at least one of the first gamma curve, the second gamma curve, and the third gamma curve.

10. The gamma correction method as claimed in claim 8, wherein the first primary-color frame, the second primary-color frame, and the third primary-color frame comprise a red frame, a green frame, and a blue frame.

11. The gamma correction method as claimed in claim 8, wherein the LCD panel is a liquid crystal on silicon panel with color filters.

* * * * *